US009355603B2

(12) United States Patent
Chu Ke et al.

(10) Patent No.: US 9,355,603 B2
(45) Date of Patent: May 31, 2016

(54) METHOD FOR ADJUSTING SATURATION DEGREE AND COLOR ADJUSTING SYSTEM

(71) Applicant: Au Optronics Corporation, Hsinchu (TW)

(72) Inventors: Hui Chu Ke, Hsinchu (TW); Sheng-Wen Cheng, Changhua (TW)

(73) Assignee: Au Optronics Corporation, Hsinchu (TW)

( * ) Notice: Subject to any disclaimer, the term of this patent is extended or adjusted under 35 U.S.C. 154(b) by 157 days.

(21) Appl. No.: 14/181,741

(22) Filed: Feb. 17, 2014

(65) Prior Publication Data

US 2015/0070404 A1 Mar. 12, 2015

(30) Foreign Application Priority Data

Sep. 12, 2013 (TW) ..... 102133044 A

(51) Int. Cl.
*G09G 3/36* (2006.01)
*G09G 5/02* (2006.01)

(52) U.S. Cl.
CPC ..... *G09G 3/3607* (2013.01); *G09G 5/02* (2013.01); *G09G 2320/0666* (2013.01); *G09G 2340/06* (2013.01)

(58) Field of Classification Search
CPC ..... G09G 3/3607; G09G 2340/06
See application file for complete search history.

(56) References Cited

U.S. PATENT DOCUMENTS 6,075,557 A * 6/2000 Holliman ..... G02B 27/225 348/169
6,476,877 B2 11/2002 Kihara et al.
6,477,271 B1 * 11/2002 Cooper ..... H04N 1/622 358/520
8,218,866 B2 7/2012 Chu Ke
8,326,028 B2 12/2012 Nakashima et al.
8,421,925 B2 4/2013 Su et al.
8,724,031 B2 5/2014 Su et al.
9,036,087 B2 5/2015 Su et al.
2004/0240729 A1 * 12/2004 Cooper ..... H04N 1/622 382/162
2005/0248581 A1 * 11/2005 Choe ..... H04N 1/62 345/581
2005/0271267 A1 * 12/2005 Cooper ..... H04N 9/646 382/162
2007/0085856 A1 4/2007 Wang et al.
2008/0252794 A1 10/2008 Su et al.

(Continued)

FOREIGN PATENT DOCUMENTS

CN 1873771 12/2006
CN 101309432 11/2008
TW 200841748 10/2008

*Primary Examiner* — Claire X Pappas
*Assistant Examiner* — Robert Stone
(74) *Attorney, Agent, or Firm* — Jianq Chyun IP Office

(57) ABSTRACT

A method for adjusting saturation degree and a color adjusting system are provided. The method for adjusting saturation degree includes the following steps. A hue circle is divided into a plurality of hue regions, and each of the hue regions is divided into a plurality of saturation regions according to at least one saturation threshold. A plurality of first input saturation degrees of a first saturation region of a first hue region of the hue regions are weighted by a first weighting formula for obtaining a plurality of first output saturation degrees. A plurality of second input saturation degrees of a second saturation region of the first hue region of the hue regions are weighted by a second weighting formula for obtaining a plurality of second output saturation degrees. The first weighting formula is different from the second weighting formula.

8 Claims, 3 Drawing Sheets

(56) References Cited

U.S. PATENT DOCUMENTS

2009/0252410 A1* 10/2009 Chu Ke ..... H04N 9/68 382/167
2009/0273615 A1* 11/2009 Ohnishi ..... G09G 5/026 345/690
2010/0202684 A1* 8/2010 Mattausch ..... G06T 7/0081 382/164
2010/0260412 A1* 10/2010 Yamazaki ..... H04N 1/644 382/164
2010/0260413 A1* 10/2010 Yamazaki ..... G06T 5/009 382/164
2011/0090369 A1* 4/2011 Yanagita ..... H04N 1/56 348/234
2013/0201402 A1 8/2013 Su et al.
2014/0204274 A1 7/2014 Su et al.

* cited by examiner

METHOD FOR ADJUSTING SATURATION DEGREE AND COLOR ADJUSTING SYSTEM

CROSS-REFERENCE TO RELATED APPLICATION

This application claims the priority benefit of Taiwan application serial no. 102133044, filed on Sep. 12, 2013. The entirety of the above-mentioned patent application is hereby incorporated by reference herein and made a part of this specification.

BACKGROUND OF THE INVENTION

1. Field of the Invention

The invention relates to a method for adjusting saturation degree and a color adjusting system, and more particularly, relates to a method for adjusting saturation degree and a color adjusting system, which are capable of adjusting saturation degree partially.

2. Description of Related Art

In recent years, liquid crystal displays are gradually developed to provide a high color saturation. Display devices with traditional sRGB specification are unable to satisfy demands of consumers today, thus development in a wide gamut display device is now an important topic to be researched in the related field.

Generally, in the wide gamut display device, further color adjustment is required since a display gamut has been expended. In a RGB (abbreviation of Red, Green, Blue) color space, colors of R, G, B are highly related to each other. Accordingly, for the convenience of adjusting color and intensity, the RGB color space is usually converted into a HSI color space in conventional technology, in which H refers to hue, S refers to saturation and I refers to intensity. In the HSI color space, H, S and I can be adjusted through a real-time computation by a hardware. For instance, the existing method for adjusting color is capable of simultaneously increasing and decreasing saturation of colors.

For instance, to allow a flower color of roses or sunflowers in an image to be more vivid, the wide gamut display device can increase a saturation degree of red or yellow. However, by doing so, an over-saturation may occur in a skin color of people in a displaying image, such that a chromatic distortion in which the skin color is overly red or overly yellow may also occur, thereby influencing a quality of the displaying image.

Therefore, in order to satisfy demands of the consumers in image quality, how to provide a high color saturation for the displaying image while having a favorable effect in color reproduction has become a primary target for persons skilled in the art.

SUMMARY OF THE INVENTION

The invention is directed to a method for adjusting saturation degree, capable of providing a displaying image with effects of high color saturation and favorable effect in color reproduction.

The invention is also directed to a color adjusting system, capable of providing a displaying image with effects of high color saturation and favorable effect in color reproduction.

The method for adjusting saturation degree includes the following steps. A hue circle is divided into a plurality of hue regions, and each of the hue regions is divided into a plurality of saturation regions according to at least one saturation threshold. A plurality of first input saturation degrees of a first saturation region of a first hue region of the hue regions are weighted by a first weighting formula for obtaining a plurality of first output saturation degrees. A plurality of second input saturation degrees of a second saturation region of the first hue region of the hue regions are weighted by a second weighting formula for obtaining a plurality of second output saturation degrees. The first weighting formula is different from the second weighting formula.

The color adjusting system of the invention includes a first color coordinate system converter, a saturation adjuster and a second color coordinate system converter. The first color coordinate system converter is configured to convert a first red signal, a first green signal and a first blue signal into a hue, a first input saturation degree and an intensity. The saturation adjuster is coupled to the first color coordinate system converter and configured to receive the first input saturation degree and the hue. The saturation adjuster weights the first input saturation degree by weighting formulae being different based on positions of the first input saturation degree and the hue in the hue circle for obtaining a first output saturation degree. Therein, the hue circle is divided into a plurality of hue regions, each of the hue regions is divided into a plurality of saturation regions according to at least one saturation threshold, and the weighting formulae in the different saturation regions within the same hue region are different to each other. The second color coordinate system converter is coupled to the first color coordinate system converter and the saturation adjuster, and configured to receive the intensity, the hue and the first output saturation degree. The second color coordinate system converter is configured to convert the intensity, the hue and the first output saturation degree into a second red signal, a second green signal and a second blue signal.

In summary, according to the method for adjusting saturation and the color adjusting system provided in the embodiments of the invention, the input saturation degrees of the input image signals of different saturation regions within the same hue circle are weighted by using different weighting formulae. Accordingly, the displaying image can achieve effects of increasing saturation degrees of colors in the pixels with high saturation, and maintaining colors in the pixels with low saturation and the skin color being natural. As a result, the displaying image with effects of the high color saturation and the favorable effect in color reproduction can be provided.

To make the above features and advantages of the disclosure more comprehensible, several embodiments accompanied with drawings are described in detail as follows.

DESCRIPTION OF THE EMBODIMENTS

Figure 1:
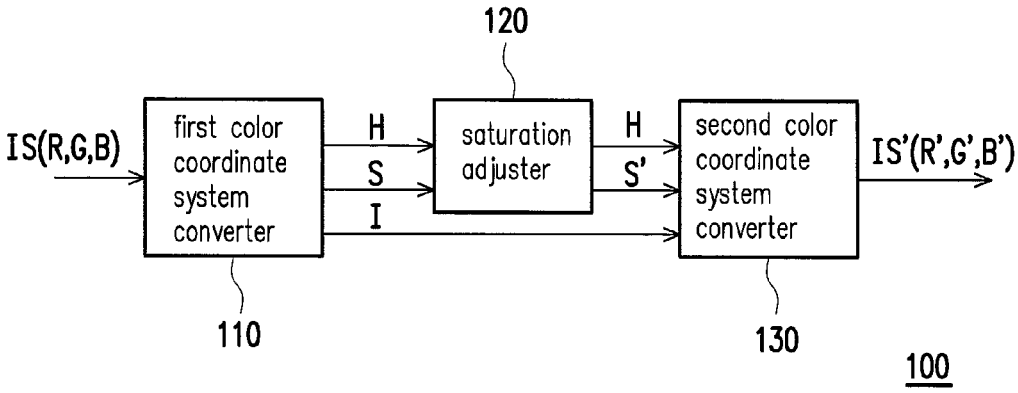
FIG. 1 is a block diagram of a color adjusting system according to an embodiment of the invention.
Figure 2A:
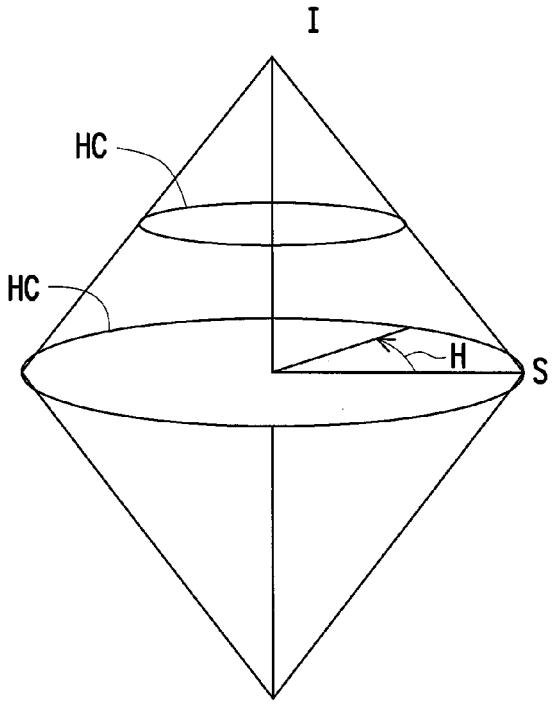
FIG. 2A is a schematic diagram of a HSI color space.
Figure 2B:
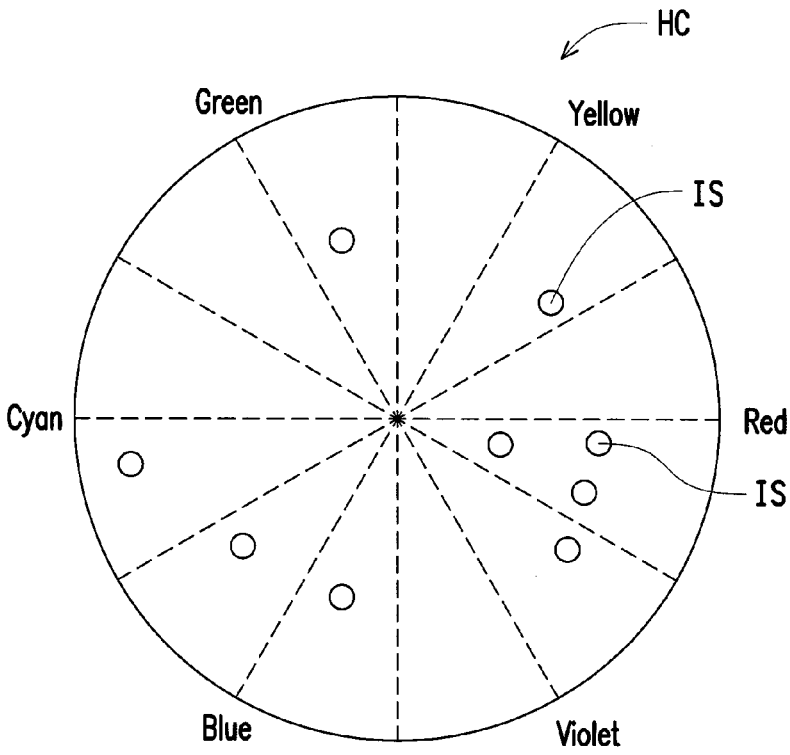
FIG. 2B is a schematic diagram of a hue circle of FIG. 2A.

FIG. 1 is a block diagram of a color adjusting system according to an embodiment of the invention. FIG. 2A is a schematic diagram of a HSI color space. FIG. 2B is a schematic diagram of a hue circle of FIG. 2A. Referring to FIG. 1, in the present embodiment, a color adjusting system 100 includes a first color coordinate system converter 110, a saturation adjuster 120 and a second color coordinate system converter 130. For instance, an input image signal IS of each pixel in a displaying image in the RGB color space can generally be represented by a first red signal R, a first green signal G and a first blue signal B. In the present embodiment, the first color coordinate system converter 110 can be used to convert the first red signal R, the first green signal G and the first blue signal B into a hue H, a first input saturation degree S and an intensity I, so that the input image signal IS of each pixel in the displaying image can be instantly calculated and adjusted in the HSI color space.

For instance, as shown in FIG. 2A, the HSI color space can be illustrated in a conical space model, in which a vertical axis is configured to indicate the intensity I of the input image signal IS of each pixel in the displaying image, and a plurality of hue circles HC parallel to a horizontal plane are configured to indicate the hue and the saturation degree of the input image signal IS. For instance, in the HSI color space, the input image signals IS of the pixels having the same intensity are within the same hue circle HC, and the hue thereof can be represented in angles. As shown in FIG. 2B, it is assumed that red, green and blue are 0°, 120° and 240°, respectively. In this case, colors at 0° to 120° can be obtained by mixing red and green; colors at 120° to 240° can be obtained by mixing green and blue; colors at 240° to 360° can be obtained by mixing blue and red, and 360° and 0° both represent red. On other hand, the saturation degree of the input image signal IS of the pixel can be represented by a distance of the input image signal IS away from a circle center. In other words, the saturation degree is 0 when the input image signal IS of the pixel falls on the circle, and the saturation degree becomes greater when the input image signal IS of the pixel is farther away from the circle center. Accordingly, in the HSI color space, the intensity, the hue and the saturation degree can be adjusted respectively.

On the other hand, referring back to FIG. 1, in the present embodiment, the saturation adjuster 120 is coupled to the first color coordinate system converter 110 and configured to receive the first input saturation degree S and the hue H. The saturation adjuster 120 can weight the first input saturation degree S by weighting formulae being different based on positions of the first input saturation degree S and the hue H in the hue circle HC for obtaining a first output saturation degree S'. Functions of the saturation adjuster 120 and a method for adjusting the saturation degree are further described below with reference to FIG. 3 to FIG. 4B.

Figure 3:
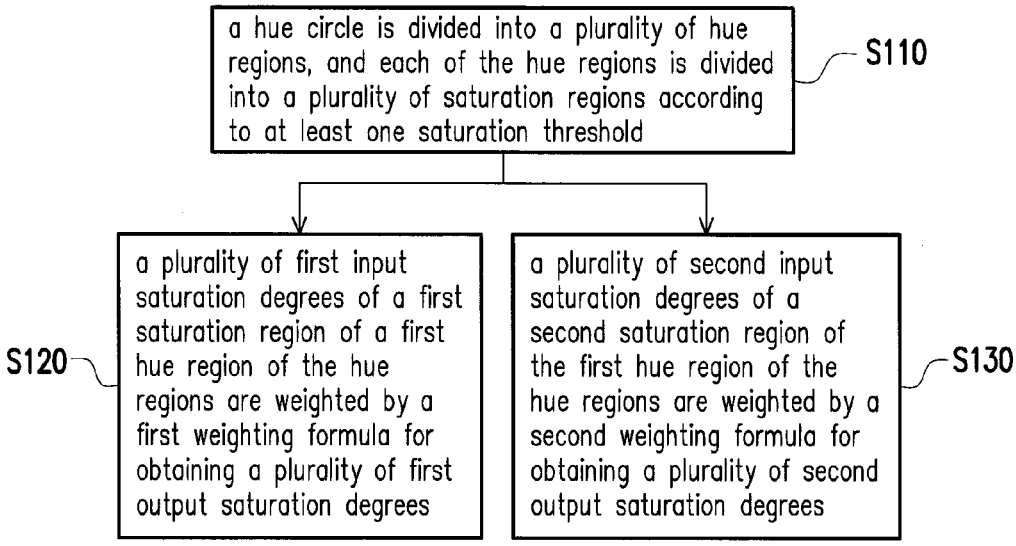
FIG. 3 is a flowchart of a method for adjusting saturation degree according to an embodiment of the invention.

FIG. 3 is a flowchart of a method for adjusting saturation degree according to an embodiment of the invention. Referring to FIG. 3, in the present embodiment, the method for adjusting the saturation degree is executed by using, for example, the saturation adjuster 120 of the color adjusting system 100, but the invention is not limited thereto. Detailed steps in the method for adjusting the saturation degree of the present embodiment are further described below.

Figure 4A:
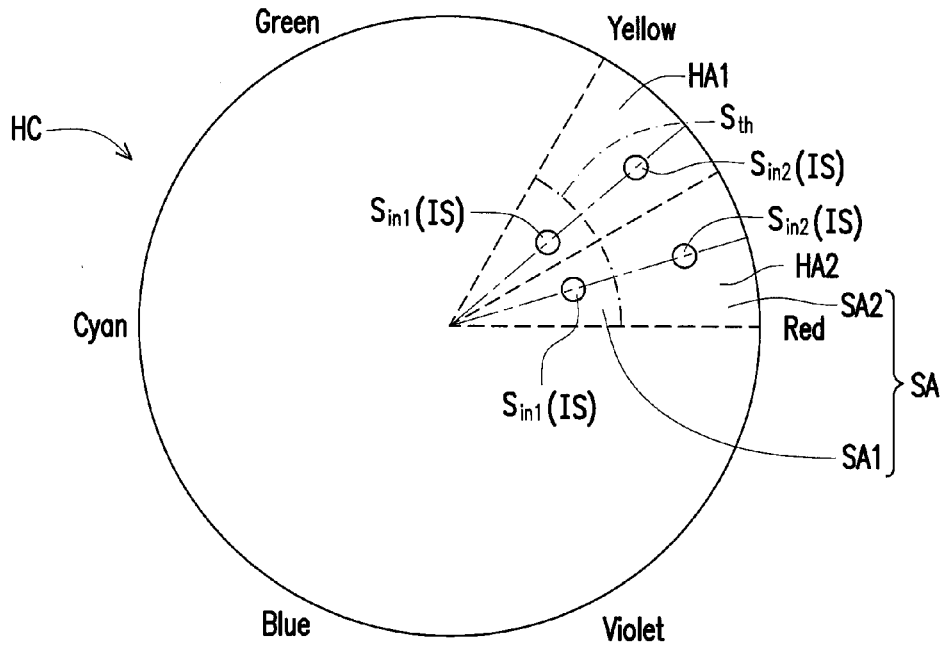
FIG. 4A is a schematic diagram of a first input saturation degree in the hue region depicted in FIG. 2.
Figure 4B:
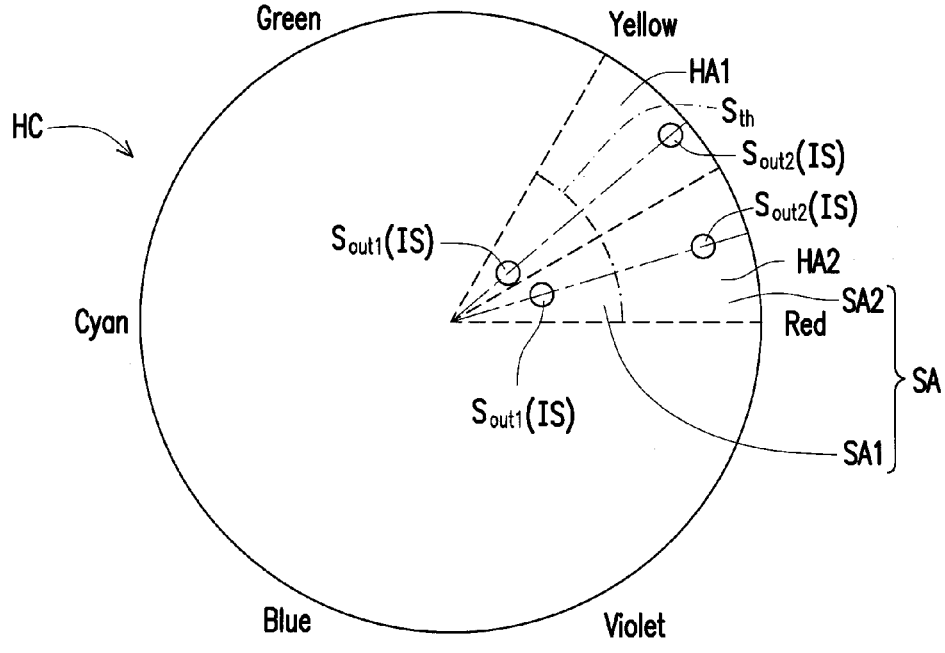
FIG. 4B is a schematic diagram of a first output saturation degree in the hue region depicted in FIG. 2.

FIG. 4A is a schematic diagram of a first input saturation degree in the hue region depicted in FIG. 2. FIG. 4B is a schematic diagram of a first output saturation degree in the hue region depicted in FIG. 2. First, in step S110, a hue circle HC is divided into a plurality of hue regions (HA1, HA2, . . . and so forth), and each of the hue regions (HA1, HA2, . . . and so forth) is divided into a plurality of saturation regions SA according to at least one saturation threshold $S_{th}$ (as shown in FIG. 4A). For instance, in the present embodiment, the saturation threshold $S_{th}$ for each of hue regions HA can be defined by the following formula:

$$S_{th} = \frac{RGB_{max} - RGB_{min}}{RGB_{max}}.$$

Therein, $RGB_{max}$ is a maximum value among trichromatic component values of a plurality of input image signals IS within the hue regions (HA1, HA2, . . . and so forth), and $RGB_{min}$ is a minimum value among the trichromatic component values of the input image signals IS within the hue regions (HA1, HA2, . . . and so forth).

Next, in steps S120 and S130, a plurality of first input saturation degrees $S_{in1}$ of a first saturation region SA1 of a first hue region HA1 (HA2) of the hue regions (HA1, HA2, . . . and so forth) are weighted by a first weighting formula for obtaining a plurality of first output saturation degrees $S_{out1}$, and a plurality of second input saturation degrees $S_{in2}$ of a second saturation region SA2 of the first hue region HA1 (HA2) of the hue regions (HA1, HA2, . . . and so forth) are weighted by a second weighting formula for obtaining a plurality of second output saturation degrees $S_{out2}$. Therein, the first weighting formula is different from the second weighting formula. In other words, since different saturation regions SA within the same hue region HA1 (HA2) may have different weighting formulae, the input image signal IS of the different saturation regions SA within the same hue region HA1 (HA2) can be adjusted differently according to actual requirements.

For instance, the first weighting formula is multiplying the first input saturation degree $S_{in1}$ by a first weighting value, and the second weighting formula is multiplying the second input saturation degree $S_{in2}$ by a second weighting value. Therein, the first weighting value is less than 1, and the second weighting value is greater than or equal to 1. In addition, the first weighted value or the second weighted value can be changed according to different values of Sin, and the weighted values can be implemented by using a look-up-table (LUT).

More specifically, in the present embodiment, the first weighting formula is multiplying by a real number less than 1, and the second weighting formula is multiplying by a real number greater than 1. Namely, the first output saturation degree $S_{out1}$ can be obtained by multiplying the first input saturation degree $S_{out1}$ by the real number less than 1, and the second output saturation degree $S_{out2}$ can be obtained by multiplying the second input saturation degree $S_{in2}$ by the real number greater than 1. Accordingly, as shown in FIG. 4B, after steps S120 and S130 are executed, in the first saturation region SA1, the first output saturation degree $S_{out1}$ is less than the first input saturation degree $S_{in1}$. In other words, in the input image signal IS within the first saturation region SA1, the hue and the intensity remain unchanged, but the saturation degree is reduced. On the other hand, in the second saturation region SA2, the second output saturation degree $S_{out2}$ is greater than the second input saturation degree $S_{in2}$. That is, in the input image signal IS within the second saturation region SA2, the hue and the intensity remain unchanged, but the saturation degree is increased. Accordingly, the displaying image being outputted can achieve effects of wide gamut, increasing saturation degrees of colors in the pixels with high saturation, and maintaining natural colors in the pixels with low saturation.

In addition, despite that a method for calculating the saturation threshold Sth utilizes $$S_{th} = \frac{RGB_{max} - RGB_{min}}{RGB_{max}}$$

as an example, but the invention is not limited thereto. In other embodiments, the saturation threshold $S_{th}$ can also be properly defined according to actual requirements. For instance, after being converted into the HSI color space, the saturation degree of the skin color is less 0.7. Therefore, in the present embodiment, the saturation threshold $S_{th}$ can be 0.7, such that the saturation degrees of colors in the pixels with high saturation are increased while the skin color in the same displaying image can maintain in natural display.

Further, in the present embodiment, the methods for adjusting saturation for each of the hue regions (HA1, HA2 . . . and so forth) can also be different, and the invention is not limited thereto. Designers can define the weighting formulae and the saturation thresholds $S_{th}$ differently for different hue regions (HA1, HA2 . . . and so forth) according to actual requirements, so as to further improve a color quality of the displaying image.

The weighting formulae as mentioned above are illustrated in real numbers as an example, but the weighting formulae can also be presented in an addition or other metamathematical formulae. The designers can properly define the weighting formulae according to actual requirements, and the invention is not limited thereto.

For instance, in another embodiment, the first weighting formula can also be multiplying by a real number less than 1, and the second weighting formula can be multiplying by a real number greater than or equal to 1. Accordingly, after step S120 and S130 are executed, any one of the first input saturation degrees $S_{in1}$ within the first saturation region SA1 can also be greater than the corresponding first output saturation degree $S_{out1}$, and any one of the second input saturation degrees $S_{in2}$ within the second saturation region SA2 can also be less than or equal to the corresponding second output saturation degree $S_{out2}$. In other words, any one of the first input saturation degrees $S_{in1}$ within the first saturation region SA1, any one of the first output saturation degrees $S_{out1}$ corresponding to $S_{in1}$, any one of the second input saturation degrees $S_{in2}$ within the second saturation region SA2, and any one of the second output saturation degrees $S_{out2}$ corresponding to $S_{in2}$, all satisfy the following mathematical relation: Sin2>Sth>Sin1, Sin1>Sout1 while Sin2≤Sout2. Accordingly, the displaying image can achieve effects of increasing saturation degrees of colors in the pixels with high saturation, and maintaining natural colors and the skin color in the pixels with low saturation.

In addition, in another embodiment, the first weighting formula can also be multiplying by a real number less than or equal to 1, and the second weighting formula can also be multiplying by a real number greater than 1. Namely, in the present embodiment, any one of the first input saturation degrees $S_{in1}$ within the first saturation region SA1, any one of the first output saturation degrees $S_{out1}$ corresponding to the $S_{in1}$, any one of the second input saturation degrees $S_{in2}$ within the second saturation region SA2, and any one of the second output saturation degrees $S_{out2}$ corresponding $S_{out2}$, all satisfy the following mathematical relation: Sin2>Sth>Sin1, Sin1≥Sout1 while Sin2<Sout2. Accordingly, the displaying image can achieve effects of increasing saturation degrees of colors in the pixels with high saturation, and maintaining natural colors and the skin color in the pixels with low saturation.

Furthermore, referring back to FIG. 1, in the present embodiment, the saturation adjuster 120 can further perform a smooth interpolation calculation for the first output saturation degree S' of each pixel, so as to prevent presence of a discontinuous saturation adjusting mode at hue borders between the hue regions (HA1, HA2, . . . and so forth) due to different weighting formulae being adopted, thereby causing reduction in the image display quality. For instance, in the present embodiment, a method of the smooth interpolation calculation includes adjusting a plurality of full scale saturation degrees corresponding to the hue borders for each of the hue regions (HA1, HA2, . . . and so forth). Next, by an adjusting method without loss in saturation level, related saturation degrees are adjusted to fall within a preset or predetermined full scale saturation range, so as to reduce an image color distortion caused by adjusting the saturation degrees, and specific implementation of said method can refer to U.S. Pat. No. 8,218,866. Accordingly, variation in distribution of the output saturation degrees corresponding to the input image signals IS for each pixel can be smoother, so that a more natural displaying image can be provided.

On the other hand, as shown in FIG. 1, in the present embodiment, the second color coordinate system converter 130 of the color adjusting system 100 is coupled to the first color coordinate system converter 110 and the saturation adjuster 120. After the color adjusting system 100 have obtained the first output saturation degree S' by using the saturation adjuster 120 to adjust each pixel in the displaying image in the HSI color space, the second color coordinate converter 130 can receive the intensity I, the hue H and the first output saturation degree S' of each pixel in the displaying image, into a second red signal R', a second green signal G' and a second blue signal B', and outputs an adjusted image signal IS', so as to display the displaying image with effects of the high color saturation and the favorable effect in color reproduction.

In summary, according to the method for adjusting saturation and the color adjusting system provided in the embodiments of the invention, the input saturation degrees of the input image signals of different saturation regions within the same hue circle are weighted by using different weighting formulae. Accordingly, the displaying image can achieve effects of increasing saturation degrees of colors in the pixels with high saturation, and maintaining natural colors in the pixels with low saturation. As a result, the displaying image with effects of the high color saturation and the favorable effect in color reproduction can be provided.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A method for adjusting saturation degree, comprising:

dividing a hue circle into a plurality of hue regions, and dividing each of the hue regions into a plurality of saturation regions according to at least one saturation threshold;

weighting a plurality of first input saturation degrees of a first saturation region of a first hue region of the hue regions by a first weighting formula for obtaining a plurality of first output saturation degrees; and weighting a plurality of second input saturation degrees of a second saturation region of the first hue region of the hue regions by a second weighting formula for obtaining a plurality of second output saturation degrees, wherein the first weighting formula is different from the second weighting formula, and the saturation threshold of each of the hue regions is Sth, $$Sth=(RGBmax-RGBmin)/RGBmax,$$

RGBmax is a maximum value among trichromatic component values of a plurality of input image signals within the hue region, and RGBmin a minimum value among the trichromatic component values of the input image signals within the hue region.

2. The method for adjusting saturation degree of claim 1, wherein the first weighting formula is multiplying by a real number less than 1, and the second weighting formula is multiplying by a real number greater than or equal to 1.

3. The method for adjusting saturation degree of claim 1, wherein the first weighting formula is multiplying by a real number less than or equal to 1, and the second weighting formula is multiplying by a real number greater than 1.

4. The method for adjusting saturation degree of claim 1, wherein the saturation threshold is 0.7.

5. The method for adjusting saturation degree of claim 1, wherein the saturation threshold of one of the hue regions is Sth, in the one of the hue regions, $Sin2>Sth>Sin1$, $Sin1\geq Sout1$ while $Sin2<Sout2$; or $Sin2>Sth>Sin1$, $Sin1>Sout1$ while $Sin2\leq Sout2$, Sin1 is any one of the first input saturation degrees within the first saturation region, Sout1 is the first output saturation degree corresponding to Sin1, Sin2 is any one of the second input saturation degrees within the second saturation region, and Sout2 is the second output saturation degree corresponding to Sin2.

6. A color adjusting system, comprising:

a first color coordinate system converter configured to convert a first red signal, a first green signal and a first blue signal into a first hue, a first input saturation degree and an intensity;

a saturation adjuster coupled to the first color coordinate system converter, and configured to receive the first input saturation degree and the first hue, and weight the first input saturation degree by different weighting formulae based on positions of the first input saturation degree and the first hue within a hue circle for obtaining a first output saturation degree, wherein the hue circle is divided into a plurality of hue regions, each of the hue regions is divided into a plurality of saturation regions according to at least one saturation threshold, and the weighting formulae in the different saturation regions within the same hue region are different to each other;

and wherein the saturation threshold of each of the hue regions is Sth, $$Sth=(RGBmax-RGBmin)/RGBmax,$$

RGBmax is a maximum value among trichromatic component values of a plurality of input image signals within the hue region, and RGBmin a minimum value among the trichromatic component values of the input image signals within the hue region, and a second color coordinate system converter coupled to the first color coordinate system converter and the saturation adjuster, and configured to receive the intensity, the first hue and the first output saturation degree, and convert the intensity, the first hue and the first output saturation degree into a second red signal, a second green signal and a second blue signal.

7. The color adjusting system of claim 6, wherein the weighting formulae of the saturation regions within the same hue region include multiplying by a real number less than 1, and multiplying by a real number greater than or equal to 1.

8. The color adjusting system of claim 6, wherein the weighting formulae of the saturation regions within the same hue region include multiplying by a real number less than or equal to 1, and multiplying by a real number greater than 1.

* * * * *